US006637646B1

(12) United States Patent
Muise et al.

(10) Patent No.: US 6,637,646 B1
(45) Date of Patent: Oct. 28, 2003

(54) PREFORMED BAG-IN-A-BOX CONTAINER

(75) Inventors: Herbert D. Muise, Tumwater, WA (US); Herbert Muise, Jr., Mira Loma, CA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/128,974

(22) Filed: Apr. 23, 2002

(51) Int. Cl.[7] ..... B65D 5/56; B31B 7/00

(52) U.S. Cl. ..... 229/117.01; 229/117.27; 229/117.32; 493/96; 493/98; 493/128

(58) Field of Search ..... 229/117.01, 117.27, 229/117.32, 117.33, 164.2; 493/96, 98, 128, 175, 311

(56) References Cited

U.S. PATENT DOCUMENTS

| | | | | | |
|---|---|---|---|---|---|
| 2,095,910 | A | * | 10/1937 | Bergstein | 229/117.27 |
| 2,166,388 | A | * | 7/1939 | Bergstein | 493/98 |
| 2,170,364 | A | * | 8/1939 | Bergstein | 229/117.27 |
| 2,250,249 | A | * | 7/1941 | Bergstein | 229/117.32 |
| 2,389,291 | A | * | 11/1945 | Bergstein | 229/117.01 |
| 2,438,981 | A | * | 4/1948 | Waters | 229/117.27 |
| 3,079,060 | A | * | 2/1963 | Cherrin | 229/117.33 |
| 3,113,712 | A | * | 12/1963 | Kindseth | 229/117.33 |
| 3,147,675 | A | * | 9/1964 | Cherrin | 493/128 |
| 3,459,357 | A | * | 8/1969 | Egger et al. | 493/96 |
| 3,550,833 | A | * | 12/1970 | Rahenkamp | 229/117.01 |
| 4,478,351 | A | * | 10/1984 | Homma | 229/117.32 |
| 5,421,138 | A | | 6/1995 | Muise et al. | 53/440 |
| 5,619,841 | A | | 4/1997 | Muise et al. | 53/440 |

* cited by examiner

*Primary Examiner*—Gary E. Elkins

(57) ABSTRACT

A shipping container having an internal plastic bag is described, as is the method of forming the container. A flat container blank if first formed. This differs from a conventional blank only in that it has blind score lines centered vertically on each of the end panels. Adhesive strips are placed on or adjacent the major score lines separating the face and end panels of the container. Either a flat or gusseted bag is then laid on the blank with a sealed bottom edge adjacent the outside edges of the bottom flaps of the container. An open end of the bag extends beyond the upper edge of the container. The blank is then folded along the blind score lines to form a partially assembled container that can be shipped flat. Final assembly can be readily done in the field. The container eliminates the need for field insertion of the bag where one is required.

15 Claims, 5 Drawing Sheets

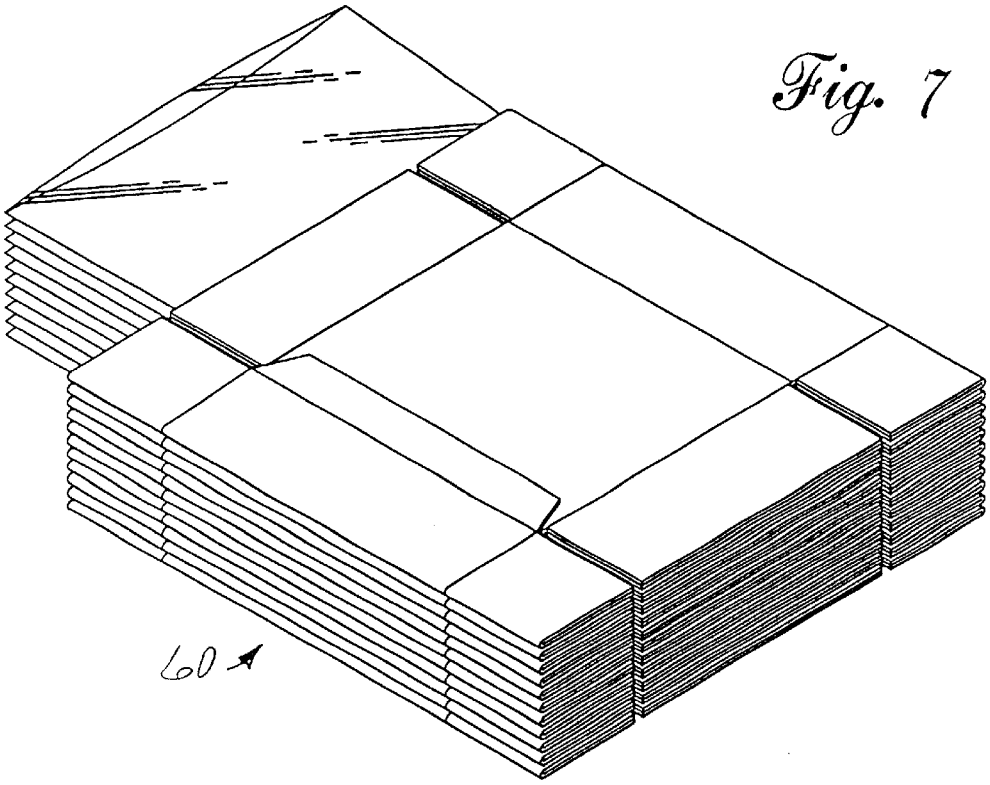
Fig. 7
Fig. 8
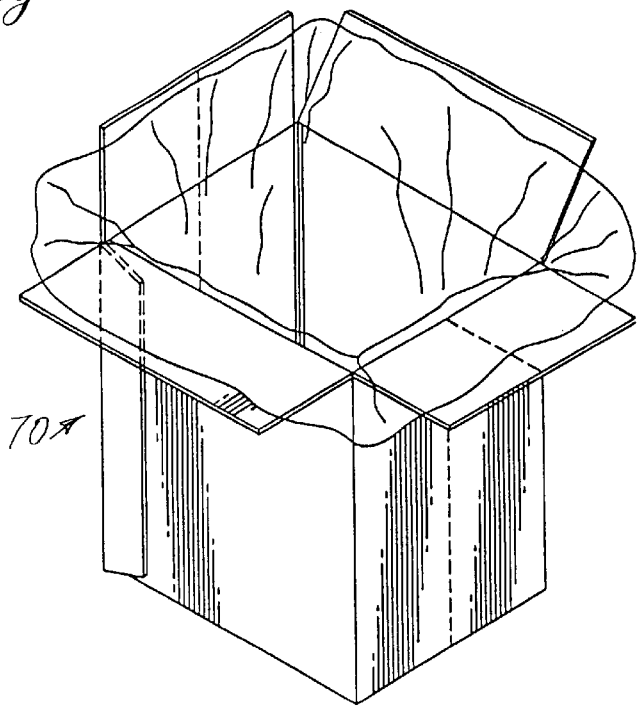

PREFORMED BAG-IN-A-BOX CONTAINER

The present invention relates to a corrugated shipping container having an integral plastic bag. The container is formed so that the bag does not have to be inserted separately when the box is set up for use. While not in any way so limited, the container is particularly useful for products such as moist fresh vegetables that are loaded in the field and then are subject to a vacuum cooling step.

BACKGROUND OF THE INVENTION

The miracle of modern transportation and storage systems has made fresh fruit and produce of the highest quality available year round. Even delicate off-season produce such as strawberries and raspberries find their way from growers in South America to tables in the United States and Canada while still in prime condition. Apples and pears are crisp and juicy six to nine months after they were picked thanks to controlled atmosphere cold storage in which oxygen level is reduced and carbon dioxide is increased. Highly perishable products are fumigated periodically with sulfur dioxide during storage to prevent deterioration due to botrytis growth. Field crops, such as celery and broccoli, may be stored for several days before they are shipped to market. If the latter two crops may be used as examples, a critical part of maintaining them in good condition is rapid chilling as soon as possible after harvest. The temperature may be brought down in chillers adjacent the growing fields. Sometimes crushed ice is applied to the produce in the container to maintain the quality. When ice is used, this requires a waxed container or one otherwise made water resistant, such as the one described in U.S. Pat. No. 6,338,234.

One method of cooling involves field packing the produce in a shipping container lined with a separate plastic bag. Liquid water is added, the amount depending on the ambient temperature of the produce when packed. A free end of the plastic bag is then tucked in over the produce providing a loose closure. Thereafter the package is palletized and inserted into a vacuum chamber where the produce temperature is rapidly reduced to its desired level for storage and shipping. A process of this type is described in detail in U.S. Pat. Nos. 5,421,138 and 5,619,841.

Some problems have arisen in conjunction with the above described procedure. One is that it generally requires one worker doing nothing but inserting the plastic bags into the boxes for use by the pickers. Another problem relates to the endemic windy conditions in the growing fields. It is quite common for the bags to blow out of the boxes before the produce is added necessitating a new bag to be supplied. An additional problem is the telescoping of the bag into the box as it is filled leaving an inadequate amount of the top portion of the bag for the required closure.

The container of the present invention has addressed all of the above problems and now provides a solution.

SUMMARY OF THE INVENTION

The present invention is directed to a corrugated shipping container containing an integral plastic bag and to the method of its formation. The method requires providing a supply of flat container blanks. These blanks will have the usual face panels and end panels defining the sides of the container and most usually a narrow panel at one end to provide a manufacturers joint when the box is formed. The blanks will also have the usual top and bottom closure flaps that may be any of several commonly used designs. The terms "face panel" and "end panel" are used based on the usual box design that is rectangular in cross section. If the ultimate box is of square cross section one set of panels may be arbitrarily assigned as "face panels" and the other set as "end panels". The usual top to bottom score lines will be present between the face and end panels. In addition, a so-called top-to-bottom "blind" score line will be placed down the center of each of the end panels and adjacent flaps. The critical function of these blind score lines will be described later.

In the usual method of preparation, the blanks will be fed from a stack onto a conveyor. Adhesive will be appropriately applied to the blanks in the desired areas of the face and end panels. The preferred area for adhesive application is along or adjacent to the score lines separating the face and end panels. Optionally, adhesive may also be applied at this time to the area of the narrow panel forming the manufacturers joint. Normally no adhesive will be applied to the flaps at this time. However, an optional small spot of adhesive; e.g., about 1 cm or less in diameter, may be used in the interior center of each flap to assist in opening the bag when the box is erected. The bottom flaps may then be glued or otherwise closed when the box is ultimately set up to receive its contents.

Plastic bags will be fed from a roll and laid down on the blanks as they advance down the conveyor line. Each bag will be longer than the distance from the outer edges of the top to bottom flaps by the amount the plastic bag is to extend from the top of the set up container. Similarly, each container blank will be spaced apart from its adjacent blank on the conveyor a distance similar to that just noted. This provides a sufficient length at the open top of the bag to form the ultimate loose closure. The bags are typically supplied end-to-end from the roll attached to each other. They will have a heat sealed closure at one and a perforated tear line at the open end, similar to the produce bags commonly supplied in grocery stores. Preferably the leading end will be the heat-sealed end. However, it should be considered to be within the scope of the invention to use the opposite arrangement; i.e., the heat-sealed end trailing. Whether leading or trailing, the heat-sealed end will be laid down roughly adjacent the outer edge of the lower flaps. Down the line the blanks with the now attached bags can be accelerated to separate the bag units along the transverse perforations.

As a final step in the process, the container blanks are now folded over upon themselves along each of the blind score lines. This brings the adhesive into contact with both sides of the plastic bag. It is convenient also to glue the manufacturer's joint at this time. The still flat containers may then be stacked for storage and shipping.

Either flat or gusseted plastic bags may be used. If flat bags are used, they will be placed on the container blank with their edges lying along the blind score lines. When gusseted bags are chosen, they will be placed on the container blank with their edges lying along the score lines defining one of the face panels. With gusseted bags, the width of the face portion should be essentially equal to the interior edge-to-edge length of the face panels of the container blank. Similarly, the extended width of the gusseted portion should be essentially equal to the interior edge-to-edge width of the end panels of the container blank. If flat bags are chosen, the combined width of both sides should be essentially equal to the inner perimeter of the container.

When the container is ultimately erected for use the end panels, which were initially folded along the blind score lines, will be extended as normal flat panels. The initial folding along the blind score lines makes box set up convenient and easy.

It is a principal object of the invention to provide a corrugated shipping container with an integral plastic bag, the container being especially useful for shipping moist products.

It is another object to provide a method of forming the above container.

These and many other objects will become readily apparent upon reading the following detailed description taken in conjunction with the drawings.

BRIEF DESCRIPTION OF THE DRAWINGS

FIG. 7 shows a stack of folded container blanks.

FIG. 8 indicates the set up container ready for filling.

DETAILED DESCRIPTION OF THE PREFERRED EMBODIMENTS

Figure 1:
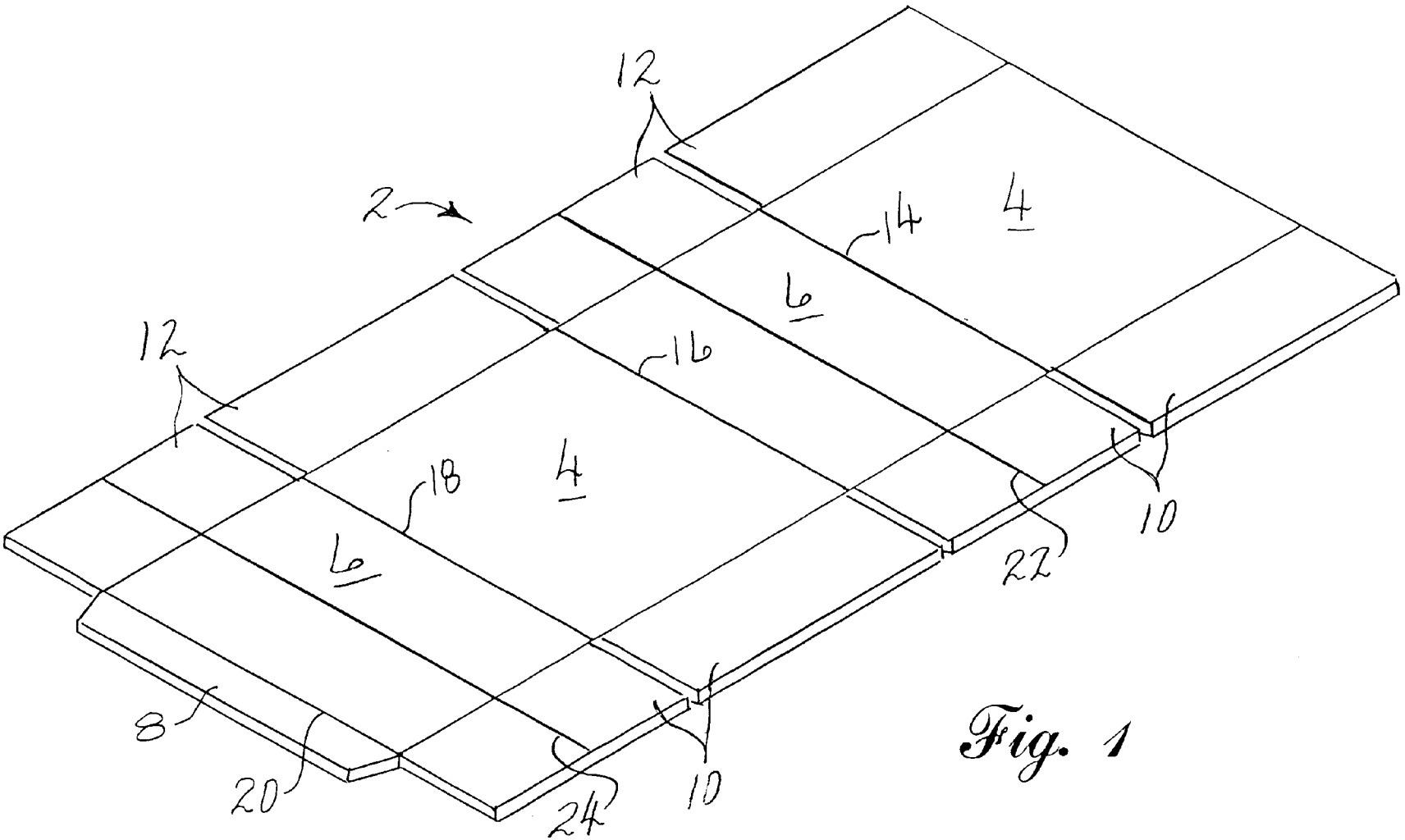
FIG. 1 represents a corrugated container blank of a type generally useful with the invention.

The invention can be readily understood by reference to the Figures. In FIG. 1 is seen a corrugated container blank 2 having major or side panels 4, minor or end panels 6, and a tab or strip 8 for forming a manufacturers joint. Blank 2 further has bottom closure flaps 10 and top closure flaps 12. Major score lines 14, 16, 18 and 20 define and separate the face and end panels. Blind score lines 22 and 24 bisect each of the end panels 6. A "blind score line" is one that is folded temporarily during the container manufacturing sequence but is not functional when the container is ultimately set up for use. Slots, not numbered, are formed as projections of the score lines in the top and bottom closure flaps.

Figure 2:
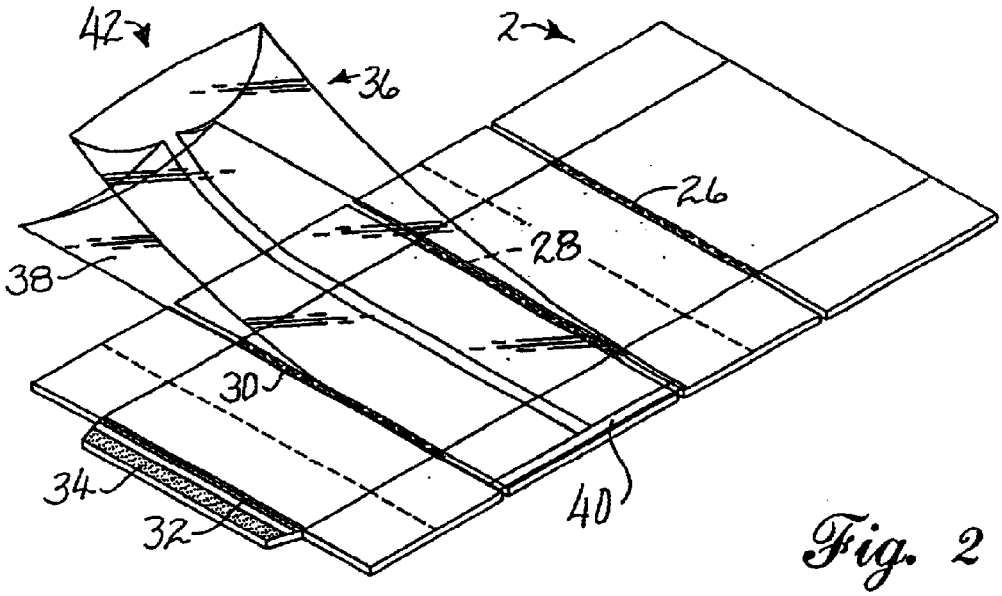
FIG. 2 shows a container blank with a gusseted bag being applied.

As seen in FIG. 2, glue strips 26, 28, 30, and 32 are laid along and/or adjacent to each of major score lines 14, 16, 18, and 20. Similarly glue 34 is applied to the tab 8 that will ultimately form the manufacturers joint. Alternatively, this joint may be made internally and the glue would be applied to the outer edge of right hand panel 4 rather than to tab 8. A gusseted plastic bag 36 is shown being laid down with its edges along score lines 16 and 18 so as to be in contact with glue strips 28 and 30. When extended, the width of the gusseted sections 38 are essentially equal to the width of end panels 6. The bottom of bag 36 is closed at 40, as by heat sealing, and lies closely adjacent the outer edges of the bottom flaps. The top 42 of bag 36 is open.

Figure 3:
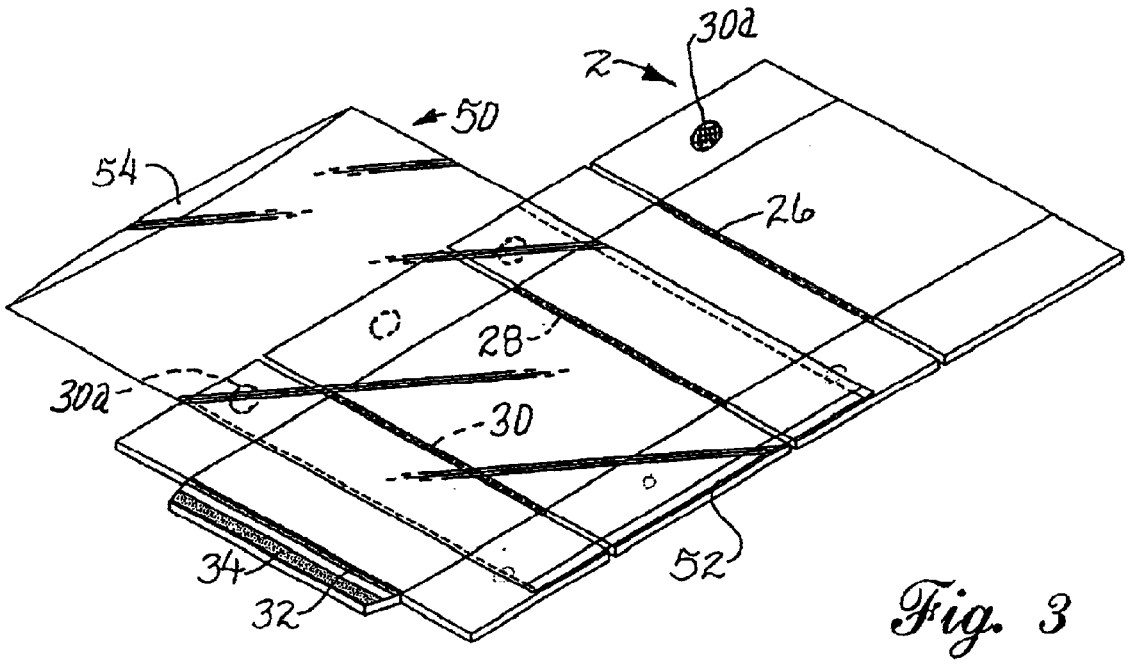
FIG. 3 is a similar figure showing a flat bag being applied.

An alternative configuration is shown in FIG. 3 where a flat bag 50 is employed. The edges of this bag lie along blind score lines 22 and 24 and it is again in contact with glue strips 28 and 30. Again, the bottom 52 of the bag is sealed and the top 54 remains open.

Figure 4:
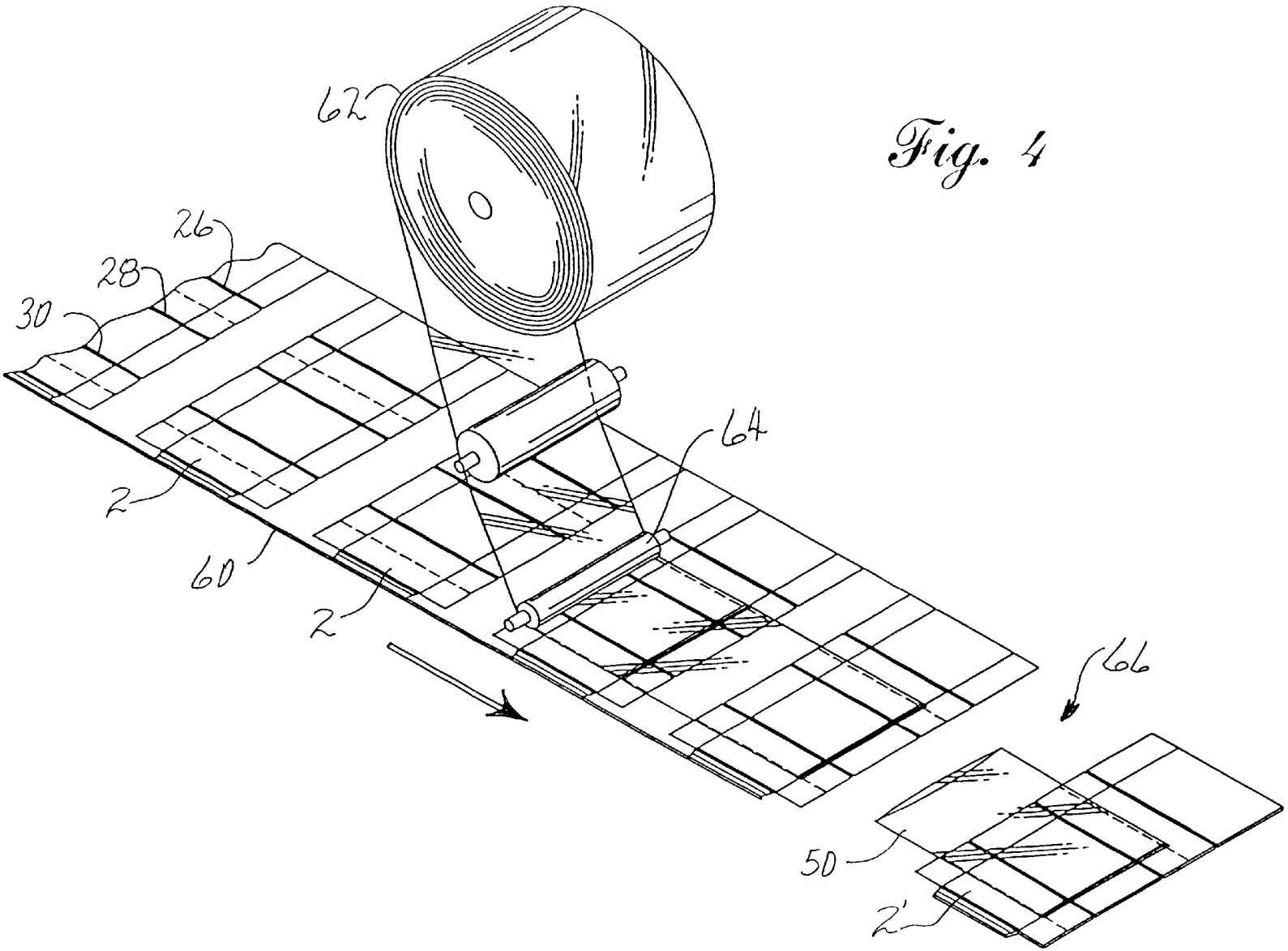
FIG. 4 shows how bags might be applied to container blanks on a production line.

FIG. 4 shows how the bags may be applied in a production situation. The container blanks 2 are on a conveyor line 6, here moving from left to right. A supply of bags 62 is provided from a roll located above the conveyor. In the present case flat bags are being supplied. These are pressed against the container blanks by a roll 64 to bond them to the adhesive lines 28 and 30 which have been applied immediately upstream by an applicator, not shown. Individual bag units are supplied end-to-end and are defined by the sealed end and a perforated tear section at the opposite end. In this regard they are similar to the familiar produce bags supplied in grocery stores. The perforated end of one unit will be closely adjacent the sealed end of the following unit. As the container blanks with the bags now partially attached reach the right hand end of the conveyor line an acceleration section generally indicated at 66 moves the container blanks 2' with bags 50 now attached so that the bag perforations are torn and the bags individualized.

There may be cases where the lower flaps might be somewhat shortened so that they leave a gap when folded. In this situation the lower sealed edge of the bag should extend somewhat beyond the edges of the lower flaps. The amount of this bag extension can be easily determined for short flaps since the bag should extend one half of the box width past the interior score line of the lower flaps.

Figure 5:
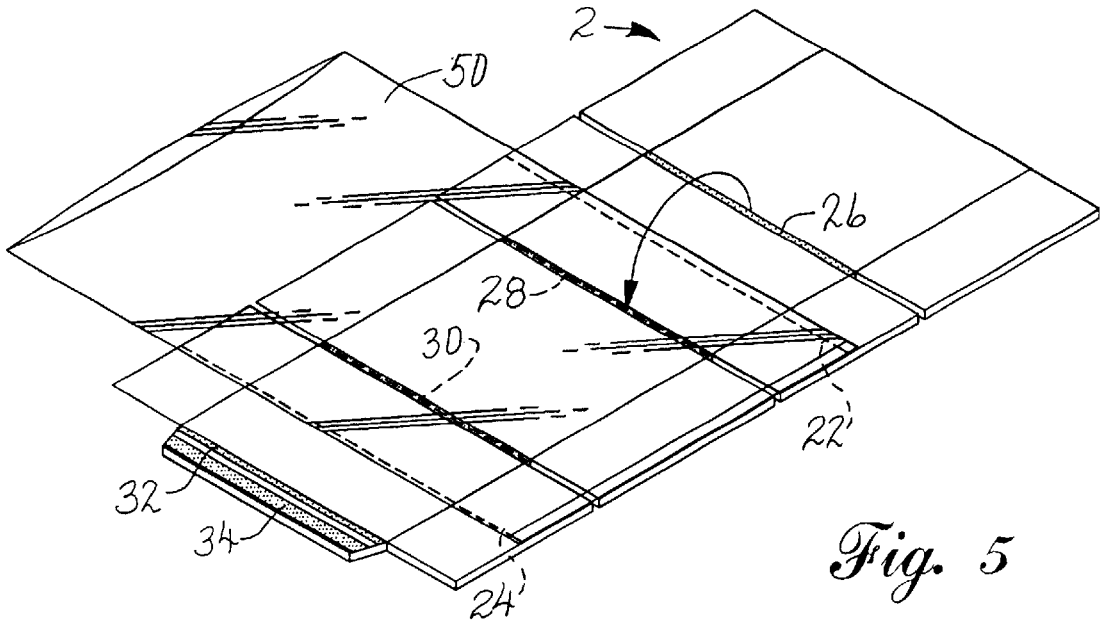
FIGS. 5 and 6 show how the container blank is folded for shipping.
Figure 6:
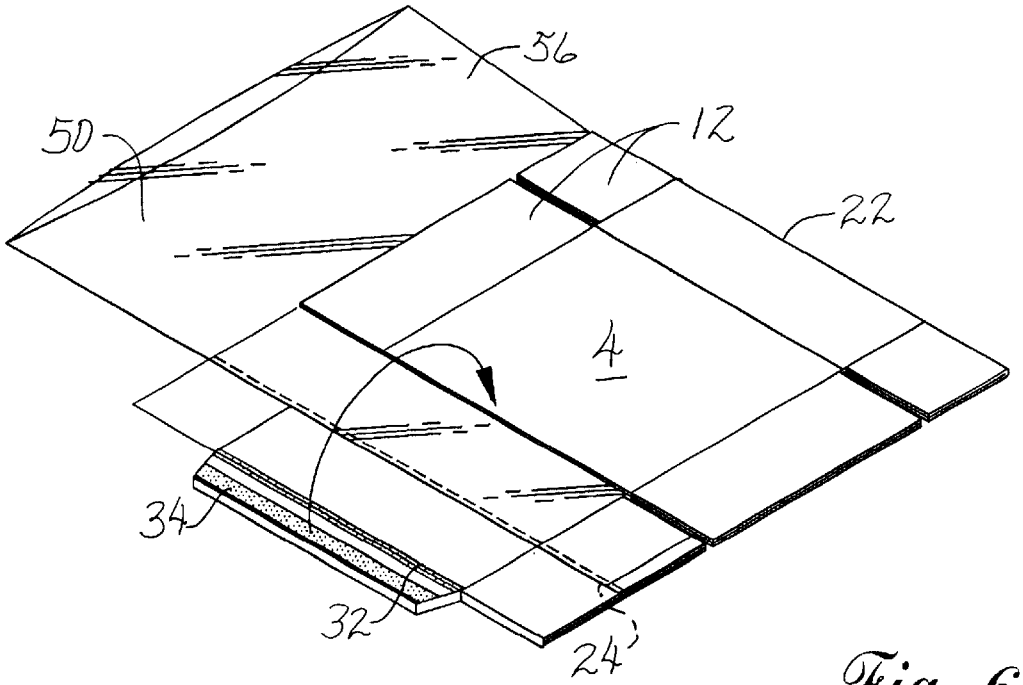

FIGS. 5 and 6 show the next steps of forming the container units. FIG. 5 shows the right hand end of container blank 2 about to be folded over along blind score line 22 so that glue strip 26 now overlies glue strip 28 on opposite sides of bag 50. Similarly, as seen in FIG. 6, the left portion of container blank 2 is being folded over along blind score line 24 so that glue strip 32 overlies glue strip 30, again on opposite sides of the bag. At the same time the manufacturer's joint is formed when glue coated tab 8 contacts the outer edge portion of face panel 4. As was noted earlier, the manufacturer's joint may be made internally rather than on the exterior of the container. The open upper portion 56 of bag 50 protrudes beyond the upper flaps 12 of container blank 2.

FIG. 7 shows a stack of blanks 60 folded as in FIGS. 5 and 6 ready for shipment to the user and ready to be further set up at or near the point of use. When the container is thus set up, a bottom portion of either bags 36 or 50 that initially lay over the lower flaps expands to overlie the bottom of the shipping container. Simultaneously, the gussets 37 of bag 36 or unglued edges of bags 50 are opened to cover the end portions of the container. To further set up the container for use the bottom flaps are glued or otherwise secured and the bag is in place as indicated at 70 in FIG. 7. The container is now ready for filling with produce or other material.

Other configurations of bottom flaps could be used rather than those shown. As an example, one pair could have locking tabs fitting into slots in the opposite pair so that the container can be set up into its configuration seen in FIG. 7 without the use of additional glue.

Referring back to FIG. 3, it should be noted that the open ends of the bags are to the left of each individual unit and the sealed end adjacent the right edge of the container blank. An equally suitable method of assembly might have the sealed end of the bag adjacent the left hand edge and the open end extending to the right.

Having thus described the invention and its method of assembly, it will be readily seen that some variations that have not been herein described would be apparent to those skilled in the art. It is the intention of the inventors that all such variations should be included within the scope of the invention if included within the breadth of the following claims.

What is claimed is:

1. A method of forming a semi-finished corrugated shipping container having an integrally contained liquid impermeable bag which comprises:

providing a supply of flat container blanks, each of the blanks having face panels, end panels, and a narrow manufacturers joint strip, each of the blanks having top and bottom closure flaps and top-to-bottom score lines between the face and end panels and along the manufacturers joint strip, each end panel further having a centered top-to bottom blind score line, the closure flaps having outer edges oriented transversely to the score lines;

providing a supply of liquid impermeable bags, each of the bags having a longitudinal axis, each of the bags further having a sealed edge and an open edge, each of the bags being longer than the distance between the outer edges of the top and bottom closure flaps;

applying an adhesive to each of the container blanks in the area of the face and end panels;

applying a small spot of adhesive in a center portion of the bottom flaps;

placing a bag upon one of the adhesive treated container blanks, the longitudinal axis of the bags being parallel to the score lines so that the sealed edge of the bags is located generally adjacent the outer edge of the bottom closure flaps; and folding the panels along the blind score lines to enclose the bag and bond it to the container blank.

2. The method of claim 1 that further includes applying adhesive to the manufacturers joint strip and sealing that manufactures joint strip when the panels are folded.

3. The method of claim 1 in which each of the bags are supplied from a continuous end-to-end source, each of the bags having a separable perforated but unsealed trailing edge; and thereafter separating each of the bag from one another.

4. The method of claim 1 in which the adhesive is applied to the container blanks along or adjacent the score lines between the face and end panels.

5. The method of claim 1 in which each of the bags have a face portion and gusseted edges, the width of the face portion being essentially equal to the interior edge-to-edge length of the face panels of the container blank and the extended width of the gusseted edges being essentially equal to the interior edge-to-edge width of the end panels of the container blank.

6. The method of claim 5 in which the edges of each bag are placed on the container blank along the score lines defining one of the face panels.

7. The method of claim 1 in which each of the bags are of flat construction with opposing face portions, the combined width of the face portions being essentially equal to the combined width of the face and end panels of the container blank.

8. The method of claim 7 in which the edges of each bags are placed on the container blank along the blind score lines on the end panels of the container blank.

9. A semi-finished corrugated shipping container having an integrally contained plastic bag which comprises:

a flat container blank, the blank having face panels, end panels, and a narrow manufacturers joint strip adjacent one end of the blank, the blank having top and bottom closure flaps and top-to-bottom score lines between the face and end panels and along the manufacturers joint panel, each end panel further having a centered top-to bottom blind score line, the closure flaps having outer edges oriented transversely to the score lines;

a flexible liquid impermeable bag bonded within the blank, the bag having a longitudinal axis parallel to the score lines, the bag further having a sealed lower edge and an open upper edge, the bag being longer than the distance between the outer edges of the top and bottom closure flaps, the bag being bonded to the container blank in the area of the face and end panels, the sealed leading edge of the bag being located adjacent the outer edge of the bottom closure flaps, the blank being folded along the blind score lines to enclose the bag, wherein the bag is additionally bonded to the blank by small spot of adhesive placed in the center portion of the bottom flaps.

10. The corrugated shipping container of claim 9 in which the bags have a face portion and gusseted edges, the width of the face portion being essentially equal to the interior edge-to-edge length of the face panels of the container blank and the extended width of the gusseted portion being essentially equal to the interior edge-to-edge width of the end panels of the container blank.

11. The corrugated shipping container of claim 10 in which the edges of the bags are located on the container blank along the score lines defining one of the face panels.

12. The corrugated shipping container of claim 9 in which the bags are of flat construction with opposing face portions, the combined width of the face portions being essentially equal to the combined length of the face and end panels of the container blank.

13. The corrugated shipping container of claim 12 in which the edges of the bags are located on the container blank along the blind score lines on the end panels of the container blank.

14. The corrugated shipping container of claim 9 in which the bag is bonded to the container blank along or adjacent to the score lines.

15. The corrugated shipping container of claim 9 which is set up as a box to receive its intended contents.

* * * * *